US006542063B2

(12) United States Patent
Kawashima et al.

(10) Patent No.: US 6,542,063 B2
(45) Date of Patent: Apr. 1, 2003

(54) ELECTRIC FUSE

(75) Inventors: Kaoru Kawashima, Maebashi (JP); Yoshihisa Tada, Funabashi (JP); Wataru Ishii, Yachiyo (JP); Takahiro Matsuda, Ibaraki-ken (JP)

(73) Assignee: Nippon Seisne Cable, Ltd., Tokyo (JP)

( * ) Notice: Subject to any disclaimer, the term of this patent is extended or adjusted under 35 U.S.C. 154(b) by 103 days.

(21) Appl. No.: 09/774,759

(22) Filed: Jan. 31, 2001

(65) Prior Publication Data

US 2002/0101324 A1 Aug. 1, 2002

(51) Int. Cl.[7] ..... H01H 85/43; H01H 85/175

(52) U.S. Cl. ..... 337/203; 337/249; 337/250; 337/186

(58) Field of Search ..... 337/260, 186, 337/187, 203, 249, 250

(56) References Cited

U.S. PATENT DOCUMENTS 4,349,804 A * 9/1982 Gaia ..... 337/198
4,417,226 A * 11/1983 Asdollahi et al. ..... 337/273
4,460,887 A * 7/1984 McAlear et al. ..... 337/186
4,837,546 A * 6/1989 Bernstein ..... 337/201
5,179,436 A 1/1993 Asdollahi et al.
5,287,079 A * 2/1994 Bernardi et al. ..... 337/203
5,668,521 A * 9/1997 Oh ..... 337/186
5,783,987 A * 7/1998 Kern et al. ..... 337/4

FOREIGN PATENT DOCUMENTS

JP 57-210537 A * 12/1982 ..... H01H/85/56

* cited by examiner

*Primary Examiner*—Anatoly Vortman
(74) *Attorney, Agent, or Firm*—John P. White; Cooper & Dunham LLP

(57) ABSTRACT

A pair of electrodes are provided through a base. A cap and the base constitute a chamber, and are connected to each other by fitting projections provided on the base, into locking grooves formed in the cap. A fuse element is connected to upper portions of the electrodes, located in the chamber, by appropriate means such as soldering or welding. The base is in the form of a rectangle having long sides and short sides. A pair of semi-elliptic air pass holes are formed in substantially central portions of the base along the respective long sides, and opposed to each other.

1 Claim, 3 Drawing Sheets

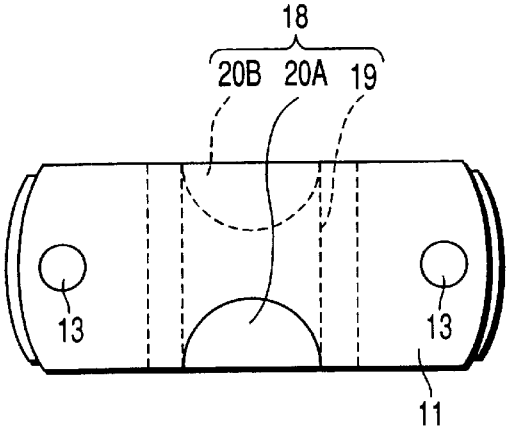
FIG. 5A
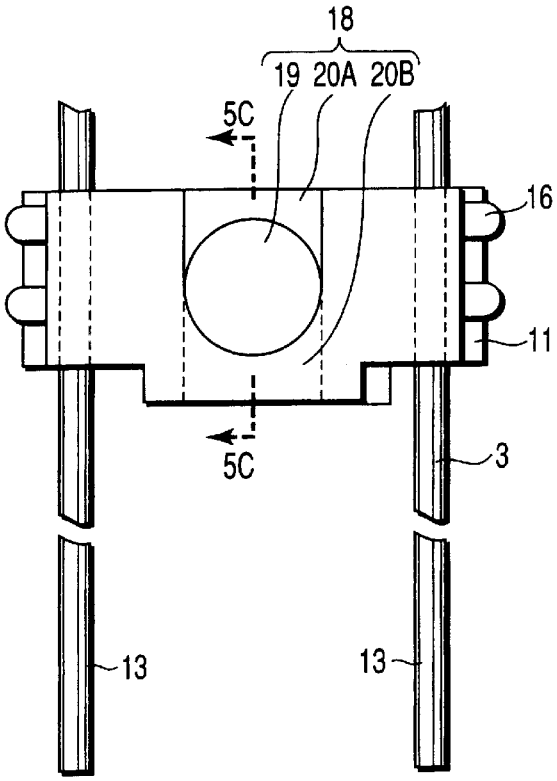
FIG. 5B
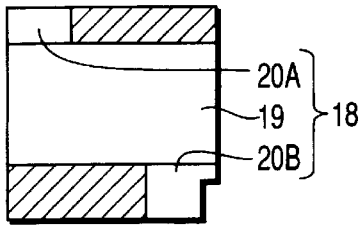
FIG. 5C
FIG. 6
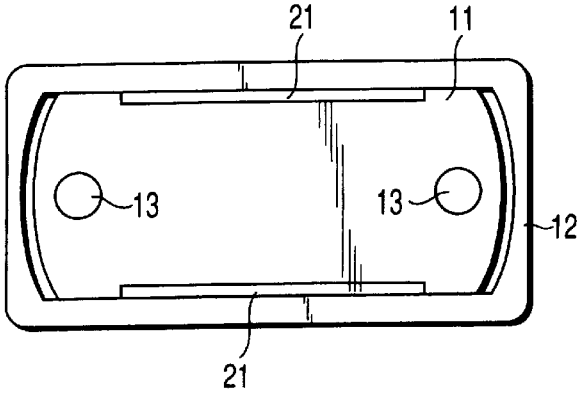

ELECTRIC FUSE

BACKGROUND OF THE INVENTION

The present invention relates to an electric fuse to be attached to a printed circuit board when it is used.

To control various electric devices, an electronic circuit is often used, which is formed of various electronic components mounted on a printed circuit board and connected to each other. In such an electronic circuit provided on a printed circuit board, it is possible that a large amount of current will flow through a circuit component due to, for example, a failure thereof, whereby the component will generate a lot of heat or be broken, thereby causing the electric device to malfunction.

To avoid this, in such an electronic circuit, an electric fuse is provided on the printed board circuit. When a lot of circuit current flows, the electric fuse blows to interrupt the circuit current, thereby preventing generation of a lot of heat and abnormal operation of an electric device as described above. However, if the pressure in a fuse case exceeds a predetermined value when the fuse blows, the case will almost burst out. This may damage another portion in the electric device.

An electric fuse used for the aforementioned purpose is disclosed in, for example, U.S. Pat. No. 5,179,436 invented by Asdollahi et al. Usually, the fuse case includes a base and a cap, and the cap is blown away from the base when the pressure in the case exceeds a predetermined value. To prevent this, the electric fuse invented by Asdollahi et al. has a case airtightly sealed with its internal pressure kept at a certain value, and a predetermined braking point is set. When a dangerous peak pressure is created, an opening is formed in the case at the predetermined braking point, through which a gas of a sufficient volume is exhausted to reduce the pressure in the case.

Since, however, an electric fuse of this type has a small outer size and a small inner volume, if it has a case airtightly sealed with its internal pressure kept at a certain value, the amount of oxygen contained in the case for burning its fuse element is inevitably small. This results in variations in the time required for blowing the fuse element between different fuse products.

Furthermore, since the base and the cap are formed of plastic and engaged with each other by fitting projections in locking grooves, it is possible that the case will fly asunder due to a high-temperature and high-pressure gas which will occur when, for example, the fuse element blows. Moreover, it is possible that an insulation failure will occur due to carbonation of the inner surfaces of the cap and the base.

BRIEF SUMMARY OF THE INVENTION

It is an object of the present invention to provide an electric fuse, which does not show a wide range of variations in the time required for its fuse element to blow.

It is another object of the invention to provide an electric fuse, in which its case is prevented from flying asunder even if a high-temperature and high-pressure gas occurs when, for example, its fuse element blows, and in which an insulation failure due to carbonation of the inner surfaces of the cap and the base of the case is prevented.

To attain the objects, the invention provides an electric fuse comprising: a base; a pair of electrodes provided through the base; a fuse element connected to the electrodes; a cap engaged with the base and constituting a case together with the base, the case containing the fuse element; and at least one air pass hole formed in the case for permitting air to always flow between an inside and an outside of the case.

Since the electric fuse has at least one air pass hole for permitting air to always flow between the inside and the outside of the case, the case is not sealed but outside air always flows into it. Accordingly, sufficient oxygen is supplied into the case, and hence the time required for blowing the fuse element can be shortened and controlled to fall within a small range of variations.

Furthermore, since a high-temperature and high-pressure gas that is generated when blowing the fuse element is discharged to the outside of the case through the at least one air pass holes, the case is prevented from flying asunder, and an insulation failure is prevented which may occur due to carbonation of the inner surfaces of the base and the cap.

Preferably, the at least one air pass hole is formed in the base.

More preferably, the base is in the form of a rectangle having long sides and short sides when viewed from above, and the at least one air pass hole is formed along one of the long sides of the base.

Further preferably, the base is in the form of a rectangle having long sides and short sides when viewed from above, and the at least one air pass hole is formed along one of the short sides of the base.

Yet preferably, the at least one air pass hole is formed in a substantially central portion of the base.

Also preferably, the at least one air pass hole is formed in a side surface of the cap.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 5A is a bottom view illustrating a small-size fuse according to a fifth embodiment of the invention;

FIG. 5B is a front view of the small-size fuse according to the fifth embodiment of the invention;

FIG. 5C is a transverse sectional view of the small-size fuse according to the fifth embodiment of the invention; and FIG. 6 is a bottom view illustrating a small-size fuse according to a sixth embodiment of the invention.

DETAILED DESCRIPTION OF THE INVENTION

The embodiments of the invention will be described with reference to the accompanying drawings.

Figure 1A:
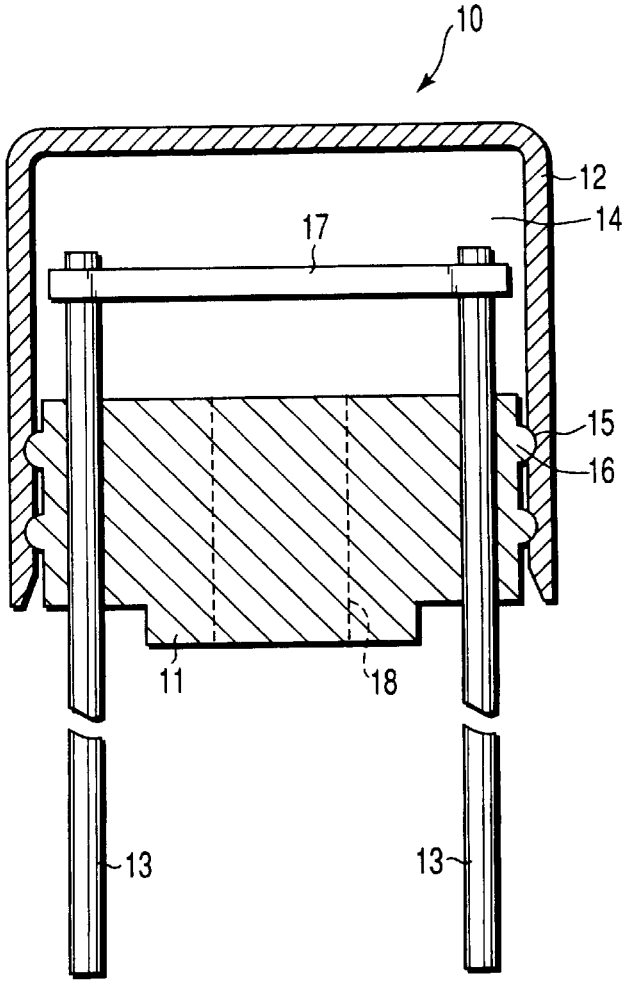
FIG. 1A is a sectional view illustrating a small-size fuse according to a first embodiment of the invention.
Figure 1B:
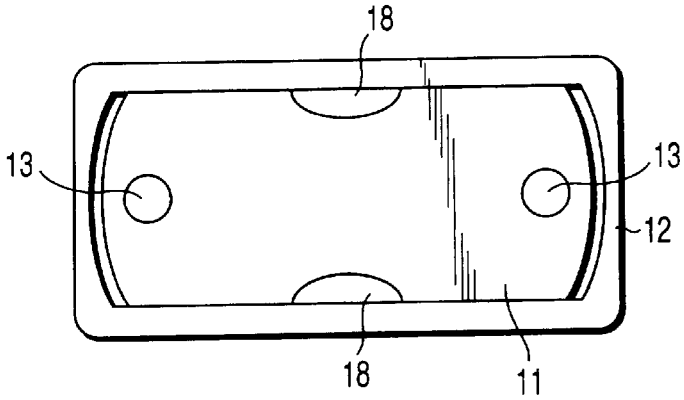
FIG. 1B is a bottom view of the small-size fuse shown in FIG. 1A.

As shown in FIGS. 1A and 1B, a case 10, incorporated in an electric fuse according to a first embodiment of the invention, is formed of a base 11 and a cap 12 as plastic components. A pair of electrodes 13 are inserted through the base 11 by a known method, with a predetermined space interposed therebetween. The cap 12 and the base 11 define a chamber 14. These elements are connected to each other by fitting projections 16 provided on the base 11, into locking grooves 15 formed in the cap 12 as shown in FIG. 1A. A fuse element 17 is fixed on upper end portions of the electrodes 13 in the chamber 14 by soldering or welding.

When viewed from the above, the base 11 is in the shape of a rectangle with long and short sides as shown in FIG. 1B. Further, a pair of semi-elliptic air pass holes 18 are formed in substantially central portions of the base 11 along the respective long sides, and opposed to each other. Air always flows between the inside and the outside of the chamber 14 through the air pass holes 18.

Accordingly, when blowing the fuse element 17, air sufficient to burn it is supplied into the chamber 14 through the air pass holes 18, thereby enabling reliable blowing of the fuse element 17. In other words, the time required for the blowing is shortened and controlled to fall within a small range of variations.

Further, since a high-temperature and high-pressure gas that is generated when blowing the fuse element 17 is discharged to the outside of the chamber through the air pass holes 18, the base 11 and/or the cap 12 is prevented from flying asunder, and an insulation failure is prevented which may occur due to carbonation of the inner surfaces of the base 11 and the cap 12.

Although in this embodiment, the air pass holes 18 are in the shape of a semi-ellipse, the invention is not limited to this. The holes may have any shape if they permit air to always flow between the inside and the outside of the chamber 14.

Figure 2:
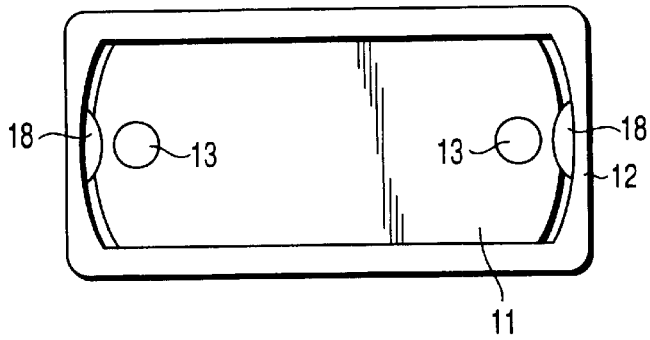
FIG. 2 is a bottom view illustrating a small-size fuse according to a second embodiment of the invention.

Referring then to FIG. 2, an electric fuse according to a second embodiment of the invention will be described. In FIG. 2, elements similar to those shown in FIGS. 1A and 1B are denoted by corresponding reference numerals. The second embodiment basically differs from the embodiment of FIGS. 1A and 1B in that in the former, a pair of semi-elliptic air pass holes 18 are formed in substantially central portions of the base 11 along the respective short sides, and opposed to each other. This embodiment having the air pass holes 18 formed in the base 11 also provides the same advantage as the embodiment shown in FIGS. 1A and 1B.

Figure 3:
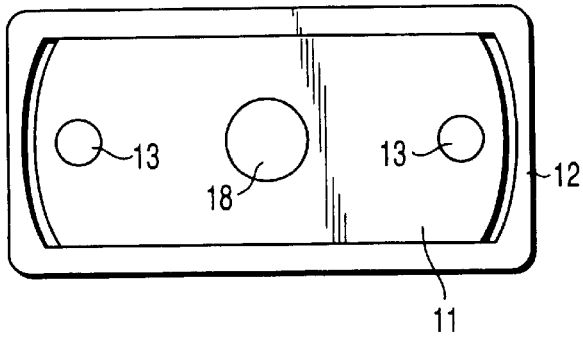
FIG. 3 is a bottom view illustrating a small-size fuse according to a third embodiment of the invention.

In an electric fuse shown in FIG. 3 according to a third embodiment, elements similar to those shown in FIGS. 1A and 1B are denoted by corresponding reference numerals. The third embodiment basically differs from the embodiment of FIGS. 1A and 1B in that in the former, a substantially circular air pass hole 18 is formed in substantially the center of the base 11.

This embodiment having the air pass hole 18 formed in the base 11 also provides the same advantage as the embodiment shown in FIGS. 1A and 1B.

Figure 4:
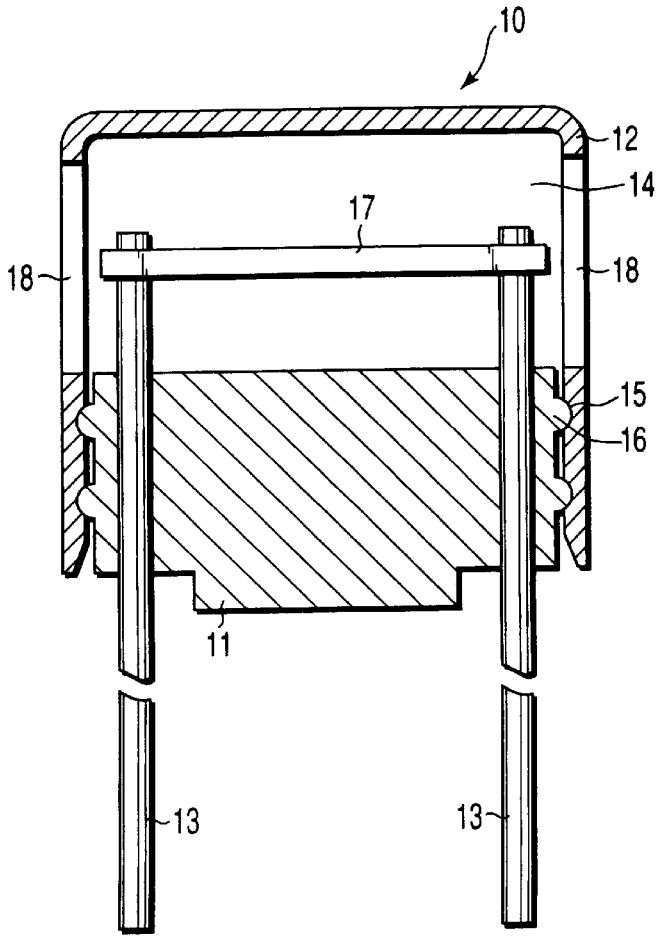
FIG. 4 is a sectional view illustrating a small-size fuse according to a fourth embodiment of the invention.

In an electric fuse shown in FIG. 4 according to a fourth embodiment, The air pass holes 18 may be in the shape of vertically extending slits as shown in FIG. 4, or in the shape of horizontally extending slits, or may have other shapes.

FIGS. 5A to 5C are a bottom view, a front view and a transverse sectional view, respectively, illustrating only a base 11 and a pair of electrodes 13 incorporated in an electric fuse according to a fifth embodiment. Since in this embodiment, a fuse element 17 connected to upper portions of the electrodes 13, and a cap 12 have the same structures as in the first to fourth embodiments, they are not shown in the figures and will not be described.

In the fifth embodiment, a through hole 19 having a substantially cylindrical cross section is formed through the base 11 and opens in a pair of opposed side surfaces of the base 11. Further, a substantially semicircular opening 20A is formed in that substantially central portion of an upper surface of the base 11, i.e. a surface defining the chamber 14, which is located along one of the long sides. The opening 20A reaches the through hole 19. Moreover, a substantially semicircular opening 20B is formed in that substantially central portion of a lower surface of the base 11, i.e. a surface opposite to the surface defining the chamber 14, which is located along one of the long sides that does not corresponds to the long side along which the opening 20A is formed. The opening 20B also reaches the through hole 19.

The through hole 19 and the openings 20A and 20B constitute an air pass hole 18 similar to those formed in the first to fourth embodiments, and permit air to always flow between the inside and the outside of the chamber 14.

Accordingly, when the fuse element 17 is blown, air sufficient to burn it is supplied into the chamber 14 through the air pass hole 18, thereby realizing reliable blowing of the fuse element. In other words, the time required for the blowing is shortened and controlled to fall within a small range of variations.

Although in the fifth embodiment, the through hole 19 and the openings 20A and 20B are cylindrical and semicircular, respectively, the invention is not limited to this. These holes may have any shape if they permit air to always flow between the inside and the outside of the chamber 14.

FIG. 6 is a bottom view illustrating an electric fuse according to a sixth embodiment of the invention. In FIG. 6, elements similar to those shown in FIGS. 1A and 1B are denoted by corresponding reference numerals, and no detailed description is given of the elements. The sixth embodiment basically differs from the embodiment of FIGS. 1A and 1B in that in the former, a pair of air pass slits 21 extend along the respective long sides of the base 11.

As experiments, an over current, which was 200% of a rated current, was flown through the fuse element 17 to blow it in a case where the air pass hole 21 was formed along one of the long side of the base 11, in a case where the air pass holes 18 were formed in substantially central portions of the base 11 along the respective long sides or short sides, and in a case where the air pass holes 18 were formed in side surfaces of the cap 12. It was confirmed from the experiments that the range of variations in the time required for blowing the fuse element in the above-mentioned cases is reduced to ⅓ or less of the time required for that in the prior art.

As described above, since the invention employs an air pass hole for permitting air to always flow between the inside and the outside of the case of a fuse element, the fuse element can be blown in a reliable manner. Further, the case is prevented from flying asunder even if a high-temperature and high-pressure gas occurs when, for example, the fuse element blows, and an insulation failure, for example, due to carbonation of the inner surfaces of the base 11 and the cap 12 is avoided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A miniature electric fuse comprising:

a base;

a pair of electrodes provided through the base;

a fuse element connected to the electrodes;

a cap engaged with the base and constituting a case together with the base, the case containing the fuse element; and at least one air pass hole formed in the case for permitting air to always flow between an inside and an outside of the case, wherein the at least one air pass hole is formed in the base, the base is in the form of a rectangle having long sides and short sides when viewed from above, and the at least one air pass hole includes:

a through hole formed through the base and opens in opposite side surfaces of the base;

a first opening formed in that substantially central portion of a surface of the base defining a chamber in the case, which is located along one of the long sides, the first opening reaching the through hole; and a second opening formed in a substantially central portion of a surface of the base opposite to the surface defining the chamber, the substantially central portion being located along that one of the long sides, which does not correspond to the one of the long sides along which the first opening is formed, the second opening reaching the through hole.

* * * * *